United States Patent [19]

Luther, Sr.

[11] 4,294,224

[45] Oct. 13, 1981

[54] FIREPLACE SCREEN AND SHIELD ASSEMBLY

[76] Inventor: Walter C. Luther, Sr., Rte. 8, Box 267, Lake City, Fla. 32055

[21] Appl. No.: 72,123

[22] Filed: Sep. 4, 1979

[51] Int. Cl.[3] ..... F23L 5/02

[52] U.S. Cl. ..... 126/135; 126/140; 126/202; 248/1; 160/DIG. 9

[58] Field of Search ..... 126/135, 138, 202, 140; 160/84 R, DIG. 9, 354; 248/1

[56] References Cited

U.S. PATENT DOCUMENTS

| | | | |
|---|---|---|---|
| 627,858 | 6/1899 | Littell | 126/135 |
| 884,222 | 4/1908 | Sherman et al. | 126/202 |
| 1,128,206 | 2/1915 | Wiegand | 126/202 |
| 3,375,818 | 4/1968 | Luther | 126/135 |

FOREIGN PATENT DOCUMENTS

| | | | |
|---|---|---|---|
| 421369 | 12/1934 | United Kingdom | 126/135 |

*Primary Examiner*—Samuel Scott
*Assistant Examiner*—Lee E. Barrett
*Attorney, Agent, or Firm*—Wood, Herron & Evans

[57] ABSTRACT

A fireplace screen and shield assembly is disclosed including a frame designed to lean against the fireplace wall and including one or more integral supports for mounting and supporting from above both a screen and a flexible, cloth-like noninflammable curtain between the fire and the room. The fireproof curtain is adjustable to various heights above the fireplace floor to control the flow of air to the fire including sealing off the fireplace opening to shut off the air to the fire and to prevent loss of room heat up the chimney. The screen is openable and closable in a vertical direction to respectively permit access to the fireplace for loading fuel therein and to prevent sparks from being projected into the room during burning. The fireplace screen and shield assembly provides the two-fold function of safe and efficient fireplace operation and energy conservation.

5 Claims, 7 Drawing Figures

FIREPLACE SCREEN AND SHIELD ASSEMBLY

BACKGROUND OF THE INVENTION

As is well known, a fireplace is a particularly popular addition to the home. In the home, a fireplace is provided in one wall of a room and is connected to a chimney which extends upwardly beyond the roof to carry off smoke, gases and the like released from the fuel while being burnt. Although fireplaces are very popular, their use is characterized by certain problems and disadvantages. For example, it is known that fireplaces are particularly inefficient heating sources. That is, during burning of a fire, a majority of the heat generated by burning goes up the chimney rather than out into the room; and, moreover, the draft of the fireplace causes the furnace-heated air in the room to likewise go up the chimney. The problem is particularly acute at night after the user has retired. If the fire is still burning, it is impossible to close the fireplace damper without causing the smoke and gases to back up into the room. Therefore, rather than wait for the fire to completely burn out and then close the fireplace damper, the user leaves the fireplace damper open overnight. Thus, furnace-heated air in the room goes up the chimney all night. Another problem associated with room fireplaces is smoking whereby smoke backs up in the chimney and enters the room. This is caused either by insufficient draft or by outside conditions, e.g., weather conditions which do not allow the smoke to be drawn up through the chimney from above the top of the flame and within the fireplace.

Another problem associated with the operation of fireplaces is that at times they are very difficult to start again because of insufficient draft.

Various workers in the art have attempted to overcome one or more of the foregoing problems and disadvantages. For example, fireplace screen constructions having openable and closable glass doors have been devised. However, these constructions are expensive, difficult to install, and do not fit all sizes of fireplaces.

SUMMARY OF THE INVENTION

It has been among the principal objects of this invention therefore to provide a fireplace screen and shield assembly which may readily be employed in connection with a fireplace to provide the two-fold function of safe and efficient fireplace operation and energy conservation. It has been a further objective of the present invention to provide a fireplace screen and shield assembly which is relatively inexpensive to produce, easy to install, and which is usable with a wide variety of type and size fireplace openings.

Another objective of the present invention has been to provide a fireplace screen and shield assembly for controlling the operation of the fireplace whereby the amount of draft may be controlled, the back-up of smoke into the room prevented, and the fireplace opening effectively sealed off to damp out the fire and to prevent furnace-heated air from otherwise going up the chimney.

These and other objects of the present invention are achieved by providing a fireplace screen and shield assembly including a generally rectangular frame defining an opening at least as large as the fireplace opening through which fuel can be fed to the fireplace, the frame being adapted to lean up against the vertical wall of the fireplace with the feet thereof resting on the hearth. The frame includes one or more integral supports for mounting and supporting from above a metal screen which is raisable in a vertical direction to permit access to the fireplace for loading fuel and is lowerable to cover the fireplace opening to prevent sparks from being projected from the fireplace into the room. The frame also supports from above and close to the wall a flexible cloth-like noninflammable curtain between the fireplace and the room. The fireproof curtain is adjustable to various heights above the fireplace floor to control the flow of air to the fire including sealing off the fireplace opening to prevent the flow of air to the fire and to prevent the loss of furnace-heated room air up the chimney when it is desired to put out the fire.

In accordance with the objectives of this invention, the frame is of a relatively simple and economical construction which is usable with a wide variety of fireplaces and size of fireplace openings. Moreover, the frame does not include any special brackets for holding it in an upright position. Rather, the weight of the fire screen and curtain hold the frame against the wall. The integral supports of the frame are located at the top close to the wall such that the curtain and screen are positionable across the fireplace opening.

Among the many advantages of the present invention, the fireproof curtain is supported by the frame close to the fireplace opening. Therefore, it is not necessary to drill and mount pins or brackets in the wall to support the curtain. The curtain is of sufficient height and width to completely seal off the fireplace opening when desired. This prevents loss of room air which would otherwise be going up the chimney perhaps for many hours. Thus, the present invention provides for energy conservation. Moreover, the fireproof curtain when sealing off the fireplace opening provides for reduced worry of a spark igniting flammable material in the room. Moreover, the curtain is adjustable in the frame to provide for a forced draft to start the fire and prevent smoke from entering the room. The fire screen and shield assembly of the present invention thus provides for a relatively safe, efficient and economical means of controlling the operation of the fireplace and for conserving energy.

Other objects and advantages of the present invention will be apparent from the following detailed description of the invention, reference being had to the accompanying drawings.

DETAILED DESCRIPTION OF THE INVENTION

Figure 1:
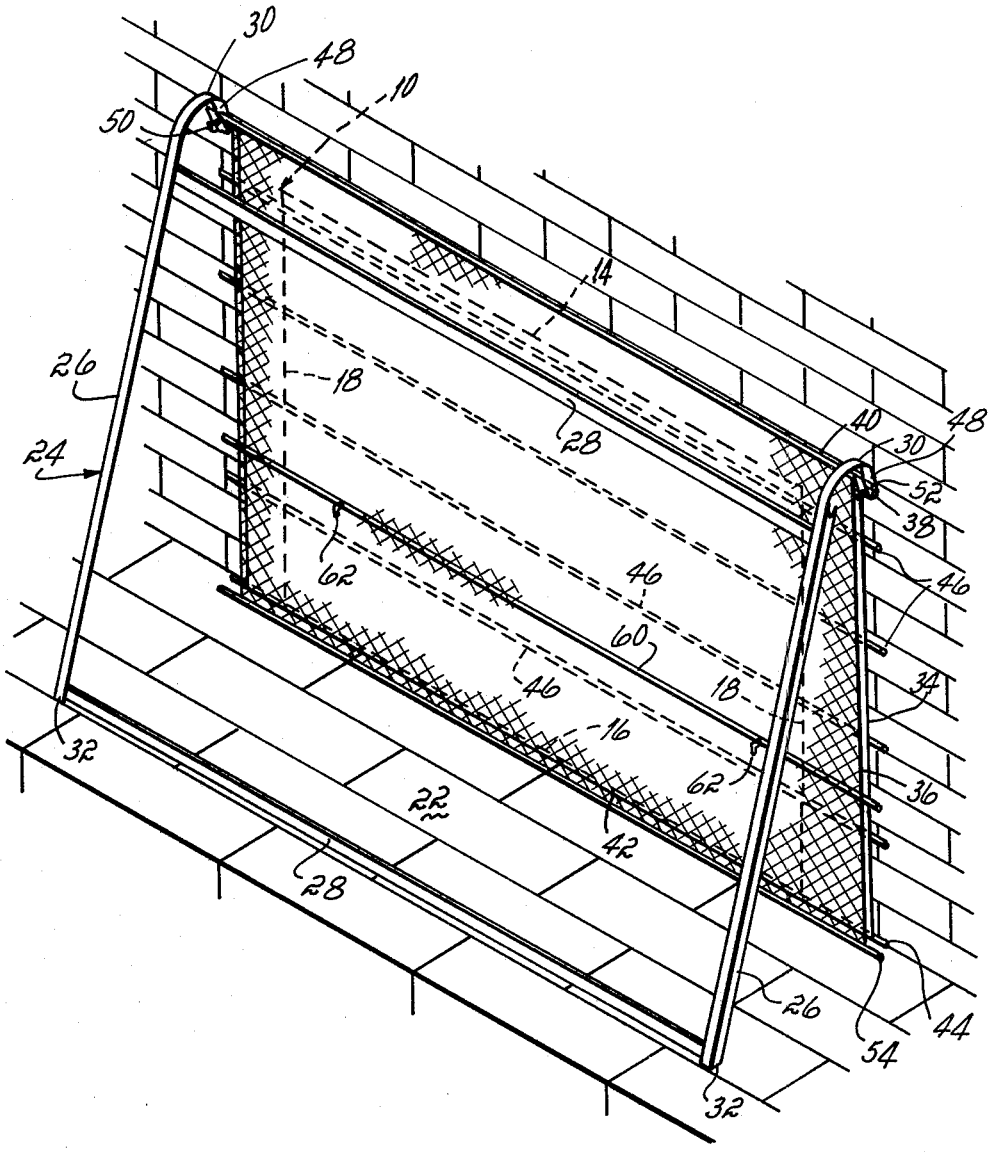
FIG. 1 is an isometric view of a presently preferred embodiment of the fireplace screen and shield assembly of the present invention.

Referring now to FIG. 1, the fireplace 10 is a chamber formed in a vertical wall 12 of a room and is connected with a chimney (not shown) which extends to the exterior of the room or house and generally projects upwardly to and beyond the roof. The fireplace 10 has a frontal opening defined by a top 14, bottom or floor 16

(FIG. 4) and connecting side edges 18, the floor 16 being located interiorly of the sides 18. The floor or bottom 16 of the fireplace 10 extends into the room to form the hearth 22. The bottom 16 and the hearth 22 are formed of a fireproof material such as brick, stone, or the like. The floor or bottom of the fireplace 10 may be above the room floor with the hearth 22 projecting into the room as a low bench or seat.

The fireplace screen and shield assembly of the present invention includes a frame 24 having a pair of side members 26 and a pair of generally horizontal cross members 28 connecting the side members and positioned close to upper and lower ends 30 and 32, respectively. The frame members may be attached by suitable fastening means such as sheet metal screws (not shown). The lower ends 32 of the side members 26 form feet which are adapted to rest on the fireplace hearth 22. The upper ends 30 are curved toward the fireplace wall 12 to provide mounting and support means for the fireplace curtain 34 and screen 36.

The curtain 34, which is described in detail in my U.S. Pat. No. 3,375,818, comprises a sheet of fireproof fabric such as woven asbestos which is very flexible. The fabric at its upper end 38 is folded around and secured to a relatively small diameter transverse metallic rod 40 and is likewise folded around at its lower end 42 and secured to a transverse metallic rod 44. At regular, relatively close intervals, the curtain is sewn across its width to provide pockets through which additional or intermediate metallic rods 46 are inserted to stiffen the curtain. The ends of the rods 40, 44 and 46 each project outwardly from the vertical side edges of the curtain 34 a substantially equal, relatively short distance. As seen from FIG. 1, the curtain 34 is of a height and width greater than that of the fireplace opening 10 such that in its closed condition as shown in FIG. 1, the curtain seals off the entire opening 10. In this condition, the projecting ends of the rods 40, 44 and 46 thus lie laterally outwardly from the vertical side edges 18 of the fireplace 10. The curtain is so mounted in the frame 24 that the projecting ends of the bars are very close to the fireplace wall 12 and in fact in the curtain closed position are in contact with it, as described below. It will also be noted that the lower end 42 of the curtain 34 rests on the hearth 22 at the level of the bottom 16 of the fireplace chamber 10.

Figure 2:
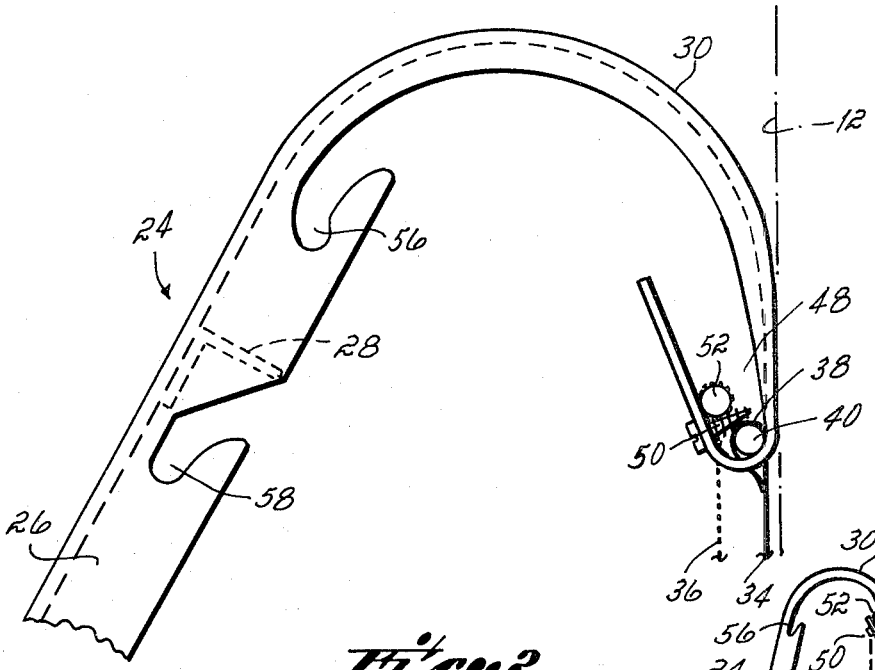
FIG. 2 is an enlarged side view of the upper end of the assembly shown in FIG. 1.

The frame 24 is adapted to lean against the fireplace wall 12 with the ends 32 of the side member 26 resting on the hearth 22. The frame 24 is formed of suitable material such as brass, aluminum or steel which is formed in right angles. At the upper ends 30 of the side members 26, a portion of the metal is cut away to permit the ends to be bent into the curvilinear shape shown in FIG. 2. However, the angle is maintained thus insuring that the ends 30 will remain relatively stiff. By bending the end back on itself, a trough 48 is formed which holds the projecting ends of the upper rod 40 passing through the upper end 38 of the curtain 34. The projecting ends of the rod 40 may be secured in the trough 48 by suitable sheet metal screws 50 passing through the frame to capture the rod 40 in the trough 48. The trough 48 also receives the projecting ends of the intermediate and bottom rods 46, 44 to lift the bottom 42 of the curtain 34 off the hearth 22 whereby the curtain may be raised and supported into an open position or a partially opened position wherein the bottom of the curtain is disposed in an intermediate position by selectively disposing one or more of the intermediate rods 46 in the trough 48.

Figure 3:
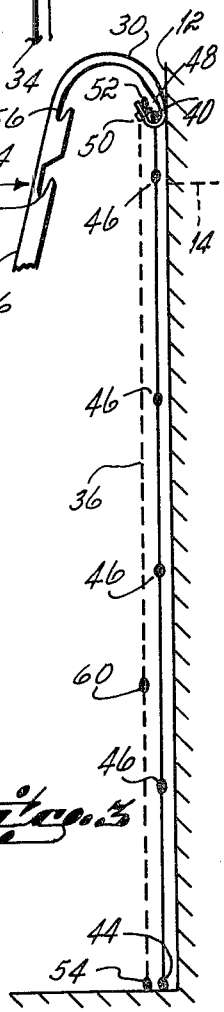
FIG. 3 is a partial side view of the assembly of FIG. 1.

Referring now in addition to FIG. 3, the metallic screen 36 is formed of a relatively stiff woven wire. The screen 36 is supported from above by a transverse metallic rod 52 whose ends project beyond the side edges of the screen. At the bottom is a like rod 54 the weight of which maintains the screen in a vertical position when supported from above by rod 52. The upper ends 30 of the side member 26 include upper and lower cutout portions or recesses 56 and 58, respectively. The upper recess 56 is adapted to receive the projecting ends of the rod 52 to move the screen away from the wall 12 while the lower recess 58 receives the bottom rod 54 and an intermediate rod 60 to selectively position the bottom of the screen above the hearth when rod 52 is in recess 56. The long axis woven wire lies in a horizontal direction such that the screen may be raised and lowered in a vertical direction. Handles 62 are provided on the rod 60 passing through the screen to lift the screen vertically. The upper rod 52 rests in the upper recess 56 to support the screen. When the screen is raised, the intermediate rod 60 is then laid in the lower recess 58 to lift the bottom rod off of the hearth to provide access to the fireplace 10.

Figure 4:
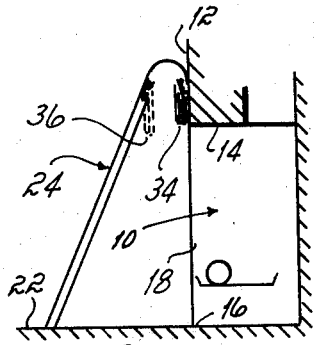
FIGS. 4–7, inclusive, are cross-sectional schematics illustrating the operation of the present invention.
Figure 5:
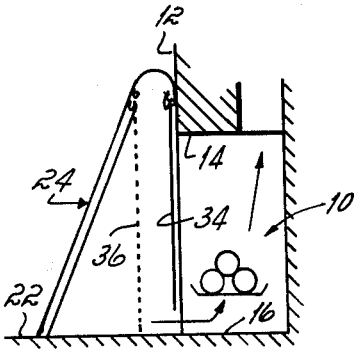
Figure 6:
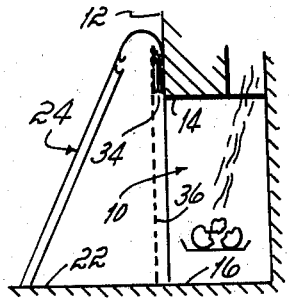
Figure 7:
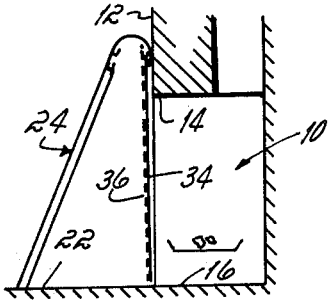

The screen as illustrated in FIGS. 4 and 5 is thus supported from above by the frame 24 and is positioned away from the wall 12. This permits access to the curtain 34 to raise and lower it. However, with reference to FIGS. 3, 6 and 7, it will be appreciated that the screen 36 may be moved from the position illustrated in FIG. 5 to a position wherein the projecting ends of the upper rod 52 lie in the trough 48 supporting the curtain 34. That is, when it is desired to lift the curtain 34, the screen 36 may be moved from the position shown in FIGS. 1 and 3 to the position shown in FIGS. 4 and 5 wherein the ends of the rod 52 lie in the recess 56. When it is desired to move the curtain close to the fireplace wall to prevent sparks or the like from spewing into the room and damaging the floor directly in front of the hearth, the projecting ends of the rods 52 may be grasped and the rod lifted out of the recess 56 and placed in the trough 48.

At all times, however, the frame 24 leans up against the fireplace wall 12 and is supported by the wall 12. Thus, the frame does not include any special brackets for holding the frame in place. Rather, the weight of the curtain 34 and screen 36 suspended from the frame holds the upper ends 30 of the frame against the fireplace wall. The angle at which the frame is disposed relative to the wall may be changed to raise the mounting rod ends 30 of the frame either vertically up or down on the wall so that the bottom of the curtain and screen rests against the hearth. As may be seen, the assembly of the present invention thus consists of a minimum number of parts.

Referring now to FIGS. 4–7, the operation of the present invention will now be explained. To load the fireplace with fuel, the fire screen 36 with its upper support rod disposed in recess 56 is raised by grasping the handles 62, lifting the screen, and placing the projecting ends of the intermediate rod 60 in the recess 58. This lifts the lower end of the screen well off the hearth allowing access through the frame members 26 and 28 to the fireplace opening 10. The curtain 34 is lifted by sequentially lifting and placing the projecting ends of the intermediate rods 46 in the trough 48 beginning with the uppermost rod and proceeding downwardly until the bottom rod 44 is placed in the trough 48. The screen and curtain are now raised to the position shown in FIG. 4.

When it is desired to start the fire, the curtain is lowered to the position shown in FIG. 5 where the bottommost rod 44 and therefore the lower edge 42 of the curtain 34 is positioned about two or three inches off the hearth 22 by selectively removing rods 44 and 46 from the trough 48 leaving only the uppermost of the intermediate rods in the trough. The positioning of the bottom of the curtain off the hearth provides a relatively small space above the bottom or floor 16 of the fireplace chamber 10 to create a relatively hard draft through the fireplace to effect very rapid starting of the fire in the fireplace. At the same time, the fire screen 36 may be lowered, however, that is not critical since the curtain 34 will prevent sparks from being projected into the room. After the fire has been started, the curtain is again raised by sequentially disposing the projecting ends of the intermediate rods 46 and the lower rod 44 in the trough 48. The screen 36, which is in its lowered position, is now moved close to the fireplace opening by grasping the projecting ends of the top supporting rod 52, lifting the rod out of the recess 56 and placing it in the trough 48. This is the position illustrated in FIG. 6 and is the normal burning condition wherein the burning fire can be observed through the screen while the screen prevents sparks from being thrown out into the room.

At times the atmospheric conditions outside the house are such that while the fire continues to burn the draft is not sufficient to draw off all the smoke within the fireplace with the result that smoke rolls out of the fireplace at the top thereof. When this condition occurs, the screen may be lifted out of the trough 48 and placed in the recess 56 and the curtain 34 lowered by sequentially removing the rods 46 from the trough to a position sufficient to prevent smoke from entering the room. The curtain 34 may be held in this position until the draft through the chimney removes the smoke after which the curtain can be again raised and the screen 36 moved toward the wall 12.

When it is desired to put out the fire, the screen 36 is moved back to its position in the recess 56 to give access to the curtain 34. The rods 44 and 46 are removed from the trough 48 to lower the curtain until its bottom 42 rests against the hearth 22 to totally seal off the fireplace opening. The screen may then be moved close to the wall to the position illustrated in FIG. 7. As mentioned above, the weight of the screen and curtain holds the upper end of the frame against the fireplace wall to provide a very safe and efficient construction. In this position, the curtain not only extinguishes the fire but prevents the room air from entering the fireplace and going up the chimney. That is, in the position of the curtain illustrated in FIGS. 3 and 7, the curtain seals off the fireplace opening. The draft created by the burning fire in the fireplace tends to suck the curtain into the chamber 10. However, the projecting ends of rods 44, 46 which are relatively stiff, engage the wall 12 and thus keep the side edges of the curtain 34 from moving toward the fireplace opening. The action of the draft pulling the curtain against the fireplace wall thus effectively seals off the opening thereby preventing the supply of oxygen to the fire required to support combustion of the fuel within the fireplace. As a result, the fire is caused to be extinguished. In this lowered position of the curtain, the fire may be left unattended while still burning with the assurance that no harm can come from the fireplace because the curtain seals off the fireplace. Moreover, in this position, room air which is furnace-heated cannot exit up the chimney and since the curtain extinguishes the fire, the fuel within the fireplace is not unnecessarily consumed. Furthermore, the maintenance of the curtain across the fireplace opening at all times except when there is a fire burning not only prevents loss of furnace-heated room air through the fireplace but also prevents drafts along the floor of the room. The present invention thus conserves energy by preventing heat loss through the fireplace during periods of non-use. This is particularly important after the user retires since the curtain will prevent loss of room heat during the night while the fire is extinguished.

Although my invention has been described with reference to a presently preferred embodiment thereof, it will be appreciated by those skilled in the art that other forms may be adopted within the scope of my invention.

I claim:

1. A fire screen and shield apparatus for use with a fireplace including a hearth, a generally vertical wall having an opening having a top, a bottom, and connecting side edges, said apparatus comprising in combination:

a generally rectangular frame including a pair of side members and top and bottom cross members interconnecting said side members defining an opening at least as large as said fireplace opening, said frame being adapted to lean against said vertical wall with the base of said side members resting on said hearth at a position removed from said wall and the upper ends of said side members resting against said wall at a position at or above said top of said opening, a curtain formed of a fireproof fabric of a height and width at least as great as said opening for completely shielding said fireplace opening, said curtain including a transverse rod at the upper end thereof, a transverse rod at the lower end thereof, and a plurality of stiffening rods extending transversely of the curtain at spaced intervals therebetween, the opposite ends of said rods projecting laterally beyond the vertical side edges of said curtain, a metal screen of a height and width at least as great as said fireplace opening for preventing sparks from being projected from said fireplace beyond said screen, said screen including a transverse support rod at the upper end thereof, said frame including support means at the upper ends of said side members, said support means being adapted to receive the projecting ends of the top rod of said curtain to mount and support said curtain and to receive the projecting ends of said stiffening rods and said bottom rod such that said rods may be selectively disposed therein for selectively positioning the bottom rod and thereby the lower end of said curtain between a closed position wherein the bottom rod rests on the hearth, an open positon wherein the bottom rod and stiffening rods are received in said support means, and a draft position wherein said bottom rod is raised off said hearth for permitting draft along the fireplace floor and for preventing smoke from entering the room through the fireplace opening, and to receive said screen support rod to mount and support said screen at least when said curtain is in its open position.

2. The fire screen and shield apparatus of claim 1 wherein said curtain is formed of a flexible, cloth-like noninflammable fabric.

3. The fire screen and shield apparatus of claim 1 wherein said support means comprises an integral, curvilinear portion of the upper end of said side member of said frame defining a trough for receiving and supporting the projecting ends of said top rod of said curtain.

4. The fire screen and shield apparatus of claim 1 wherein said screen is formed of woven wire and is operable and closable in a vertical direction.

5. A fire screen and shield apparatus for use with a fireplace connected to a chimney and including a hearth, a generally vertical wall having an opening having a top, a bottom, and connecting side edges, said apparatus comprising in combination:

a frame including a pair of side members spaced apart a distance at least as great as the width of said opening, and a pair of cross members connecting said side members and being spaced apart a distance at least as great as the distance between the top and bottom of said fireplace opening, said side members including feet at one end thereof and first rod support means at the other end, said frame being adapted to lean against said vertical wall with said feet resting on said hearth at a position removed from said opening and with said rod support means resting against said vertical wall at a position at or above the top of said opening such that said side members are inclined toward said wall, said frame further including second rod support means spaced from said first rod support means and from said wall when said frame is in its leaning position with respect to said fireplace, a curtain formed of fireproof fabric of a height and width at least as great as said opening for completely shielding said fireplace opening, said curtain including a transverse rod at the upper end thereof, a transverse rod at the lower end thereof, and a plurality of stiffening rods extending transversely of the curtain at spaced intervals therebetween, the opposite ends of said rods projecting laterally beyond the vertical side edges of said curtain, a metal screen of a height and width at least as great as said opening for preventing sparks from being projected from said fireplace beyond said screen, said screen including a support rod at the upper end thereof and being raiseable and lowerable in a vertical direction, said first rod support means being adapted to receive the projecting ends of the top rod of said curtain to mount and support said curtain and to receive the projecting ends of said stiffening rods and said bottom rod such that said rods may be selectively disposed therein for selectively positioning the bottom rod and thereby the lower end of said curtain between a closed position wherein the bottom rod rests on the hearth, an open position wherein the bottom rod and stiffening rods are received in said first rod support means, and a draft position wherein said bottom rod is raised off said hearth for permitting draft along the fireplace floor and for preventing smoke from entering the room through the fireplace opening, said second rod support means being adapted to receive the projecting ends of said support rod of said screen, said first rod supporting means being further adapted to receive the projecting ends of said support rod of said screen to mount and support said screen at least when said curtain is in its open position.

* * * * *

UNITED STATES PATENT AND TRADEMARK OFFICE

CERTIFICATE OF CORRECTION

PATENT NO. : 4,294,224

DATED : October 13, 1981

INVENTOR(S) : Walter C. Luther, Sr.

It is certified that error appears in the above—identified patent and that said Letters Patent is hereby corrected as shown below:

In column 7, line 13, "operable" should be --openable--.

Signed and Sealed this

*Twenty-third* Day of *February 1982*

[SEAL]

*Attest:*

GERALD J. MOSSINGHOFF

*Attesting Officer*

*Commissioner of Patents and Trademarks*